US006722107B2

(12) United States Patent
Morand

(10) Patent No.: US 6,722,107 B2
(45) Date of Patent: Apr. 20, 2004

(54) APPARATUS FOR FORMING AND CONTAINING WASTE CONTAINING PACKS

(75) Inventor: Michel Morand, Montréal (CA)

(73) Assignee: Moniteure Angelcare Inc. (CA)

( * ) Notice: Subject to any disclaimer, the term of this patent is extended or adjusted under 35 U.S.C. 154(b) by 0 days.

(21) Appl. No.: 10/293,063

(22) Filed: Nov. 13, 2002

(65) Prior Publication Data

US 2003/0154696 A1 Aug. 21, 2003

(30) Foreign Application Priority Data

Feb. 15, 2002 (CA) ..... 2372143

(51) Int. Cl.[7] ..... B65B 43/28

(52) U.S. Cl. ..... 53/459; 53/567; 53/576; 53/415; 53/136.5; 53/137.2

(58) Field of Search ..... 53/567, 459, 576, 53/415, 136.5, 137.2

(56) References Cited

U.S. PATENT DOCUMENTS 4,550,553 A * 11/1985 Gaither ..... 56/202
4,790,124 A * 12/1988 Kaji ..... 53/552
4,869,049 A 9/1989 Richards et al. ..... 53/459
4,934,529 A 6/1990 Richards et al. ..... 206/303
4,991,500 A * 2/1991 Knapp ..... 100/90
5,056,293 A 10/1991 Richards et al. ..... 53/116
6,065,272 A * 5/2000 Lecomte ..... 53/576
6,370,847 B1 * 4/2002 Jensen et al. ..... 53/459

OTHER PUBLICATIONS

Google, Diaper Champ by Baby Trend, search via "diaper disposal".*

* cited by examiner

*Primary Examiner*—Rinaldi I. Rada
*Assistant Examiner*—Brian Nash
(74) *Attorney, Agent, or Firm*—Orum & Roth

(57) ABSTRACT

An apparatus for forming and containing a series of waste containing packs successively distributed along a length of flexible tubing is formed of a housing with a top portion displaying an opening to receive waste material therein and of a cassette containing a package of a flexible pleated tubing and so constructed as to enable the tubing to be dispensed therefrom downwardly into the opening. The apparatus includes a tubing pulling device rotatably mounted to the housing and including an attachment for securing one end of the tubing and an arrangement to receive the tubing in a wraparound manner when the pulling device is rotated and to form waste containing packs. The arrangement defines folds between successive packs to compress the tubing at the folds to seal the packs. The pulling device is removably mounted to the housing so as to enable the disposal of the waste containing packs from the pulling device.

16 Claims, 9 Drawing Sheets

APPARATUS FOR FORMING AND CONTAINING WASTE CONTAINING PACKS

FIELD OF THE INVENTION

The present invention relates to an apparatus for forming and containing a series of waste containing packs successively distributed along a length of flexible tubing.

BACKGROUND OF THE INVENTION

It is known, for the disposal of waste material, to use packs of flexible tubing wherein waste material is packaged in individual packs along a length of such flexible tubing. One example of a similar apparatus using such packs of flexible tubing for the ready disposal of babies' disposable nappies may be found described in U.S. Pat. No. 4,869,049 issued Sep. 26, 1989 to Richards et al. In this patent, a core is used and turned to twist the flexible material at locations between adjacent waste containing packs to seal the packs at their ends thereby providing hygienic disposal of the waste material. The packages are collected in a bin portion of the apparatus and when it is desired to remove the packages from the bin portion, the bottom of the apparatus is opened to discharge the packages to a waste disposal facility.

OBJECTS AND STATEMENT OF THE INVENTION

It is an object of the present invention to provide an improved apparatus for forming and containing a series of waste containing packs successively distributed a long a length of flexible tubing.

This is achieved by providing an apparatus for packaging waste along a length of flexible tubing comprising:

- a housing having a top portion and a bottom portion, said top portion having an opening to receive waste material therein;
- a cassette mounted adjacent to said top portion, said cassette containing a package of flexible pleated tubing and being disposed to enable said tubing to be dispensed therefrom and into said housing; and
- a tubing pulling device rotatably mounted to said housing for selectively pulling tubing from said cassette as waste material is received by said top portion opening.

In one form of the invention, the apparatus of the present invention comprises:

- a housing having a top portion and a bottom portion; the top portion displaying an opening to receive waste material therein;
- a cassette mounted to the top portion at the opening; the cassette containing a package of flexible pleated tubing and being so constructed as to enable the tubing to be dispensed therefrom and downwardly into the opening; and
- a tubing pulling device rotatably mounted to the housing; the device including:
  - (i) attachment means for securing one end of the tubing in the housing;
  - (ii) means receiving the tubing in a wraparound manner when the pulling device is rotated to form waste containing packs; the tubing receiving means defining tubing folds between successive packs thereby compressing the tubing at the folds to seal the packs;

wherein the pulling device is removably mounted from the housing to enable disposal of the waste containing packs from the pulling device.

In a preferred form of the invention, the tubing receiving means consist of a pair of arms disposed diametrically opposite from one another; sections of the tubing between the arms define the waste material packs.

In another preferred form of the invention, the pulling device includes a pair of opposite wheels mounted to opposite ends of the arms thereby forming a rotatable drum unit.

In another preferred form of the invention, at least one of the wheels displays a circumferential ratchet; while the housing includes a pawl to engage the ratchet of the wheel.

In another form of the invention, the housing has cutter means to sever the tubing for separating the packs from the tubing that extends down from the opening of the top portion.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
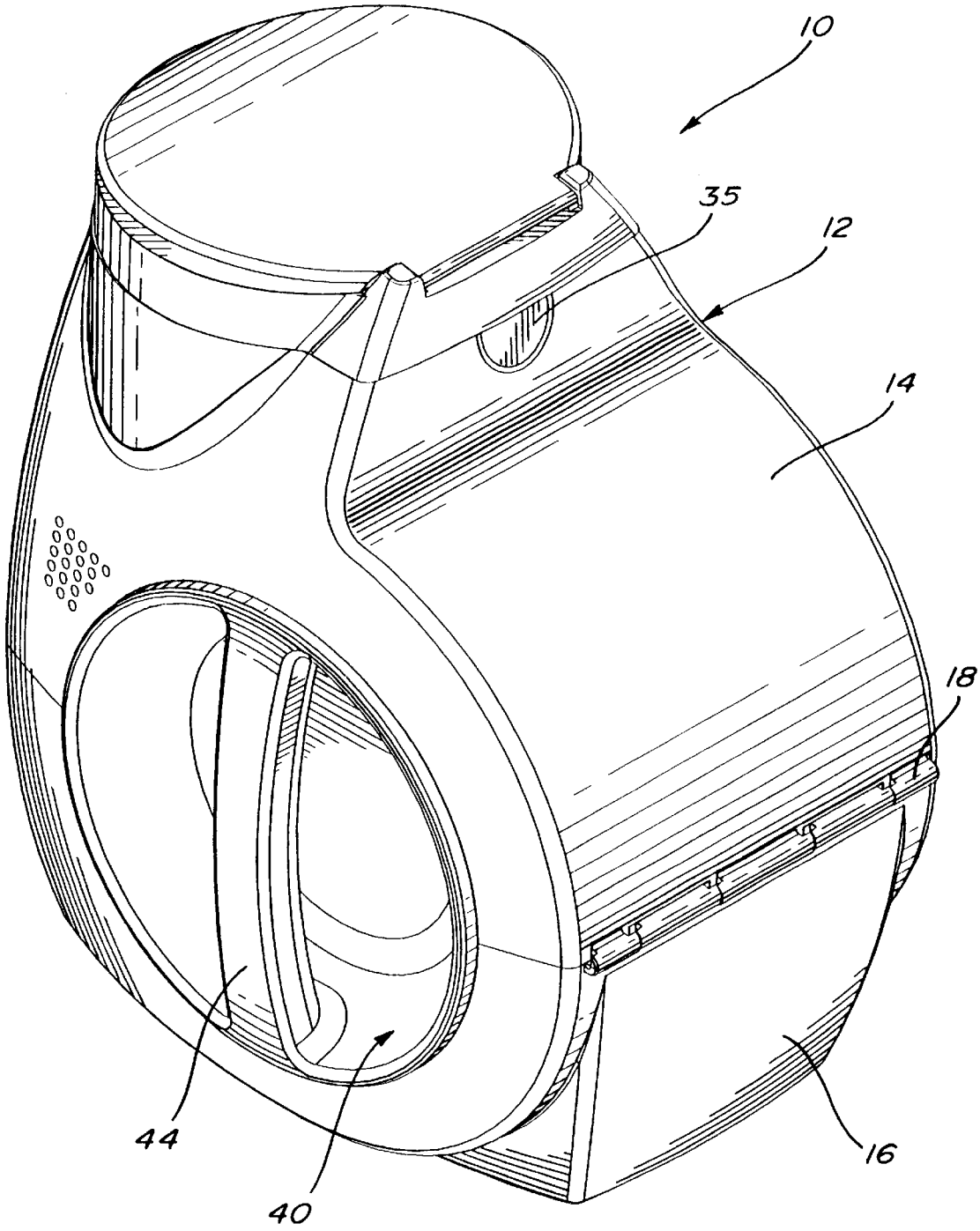
FIG. 1 is a perspective view of a first embodiment of an apparatus for forming and containing a series of waste containing packs made in accordance with the present invention.
Figure 2:
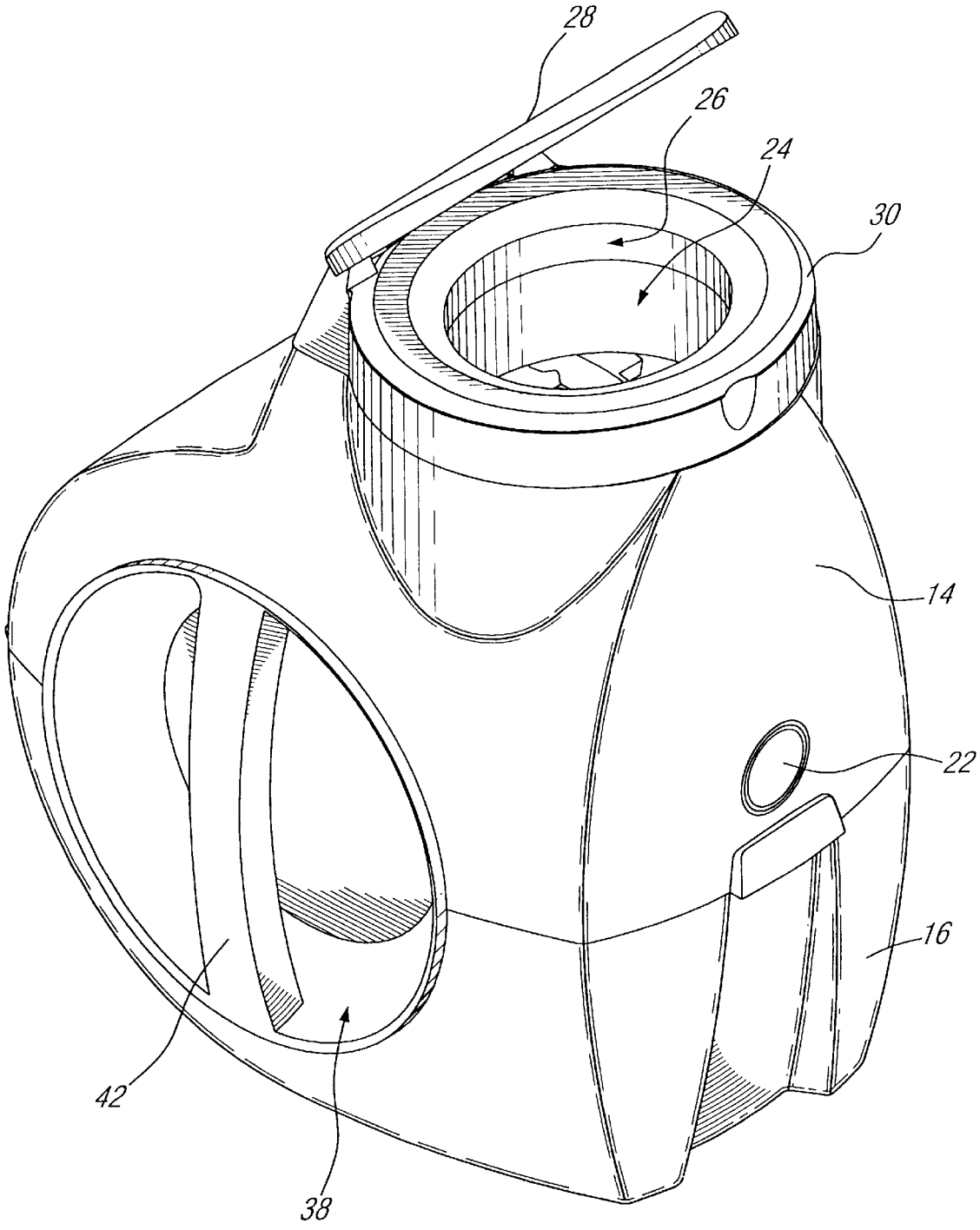
FIG. 2 is a perspective view thereof showing the other side of the apparatus with the lid shown in an opening position.
Figure 3:
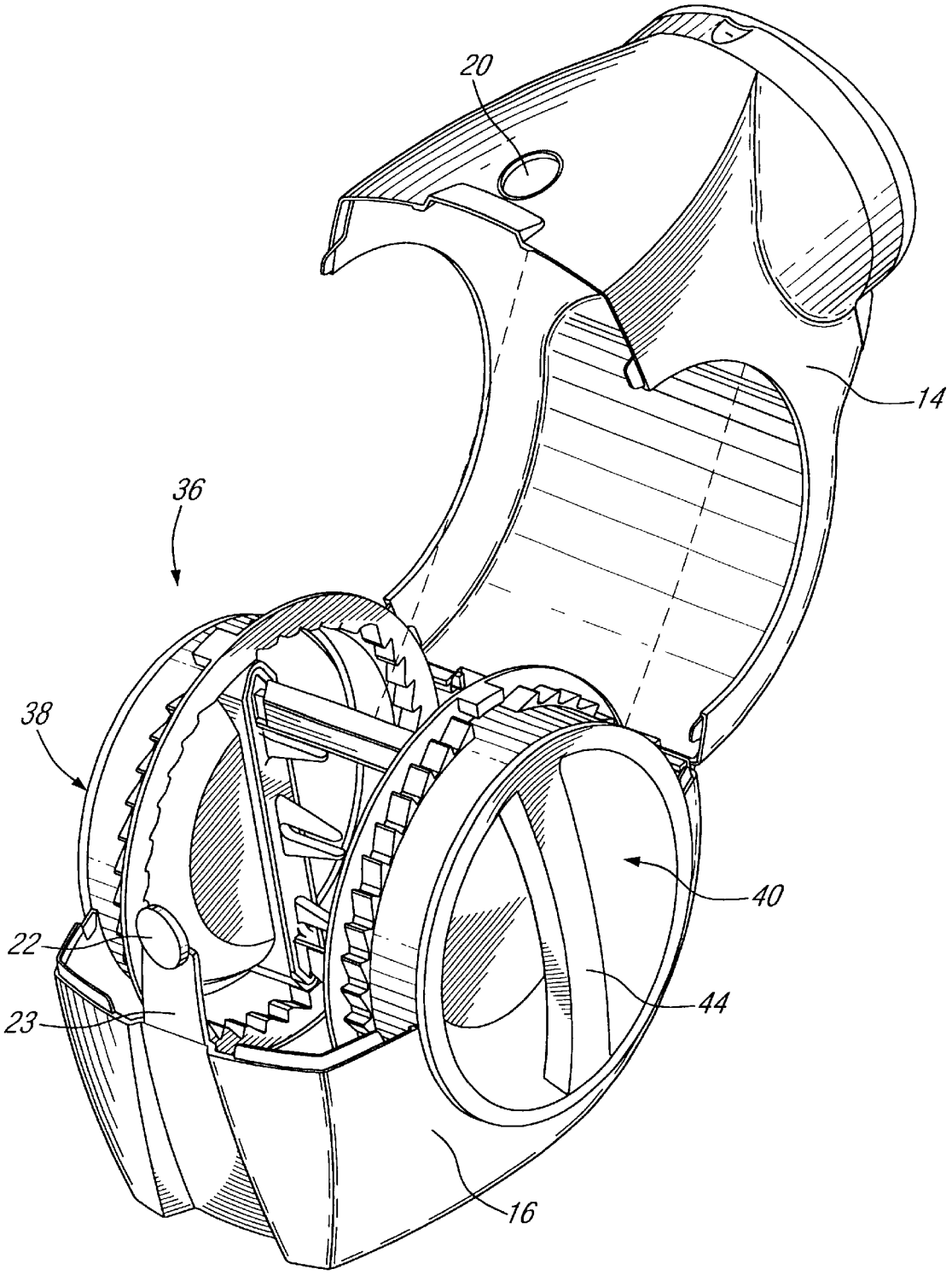
FIG. 3 is a perspective view thereof showing the inside of the apparatus.

Referring to FIGS. 1, 2 and 3, there is shown one embodiment, generally denoted 10, of an apparatus for forming and containing a series of waste containing packs made in accordance with the present invention.

The apparatus 10 comprises a housing 12 consisting of a top portion 14 and a bottom portion 16 which are hingedly connected to one another at 18 so that the top portion 14 may be opened such as illustrated in FIG. 3. The top portion 14 has an opening 20 which is adapted to engage a correspondingly shaped projection 22 of an upper tongue 23 on the bottom portion 16.

The top portion 14 displays a top opening 24 on the rim of which rests a cassette 26. The opening 24 and the cassette 26 are closed by lid means consisting of a cover 28 hingedly mounted to a cover support 30. The cover support 30 has a sloped inner surface 31 adjacent the opening 24 of the housing to assist in the disposal of waste material through the opening.

Figure 5:
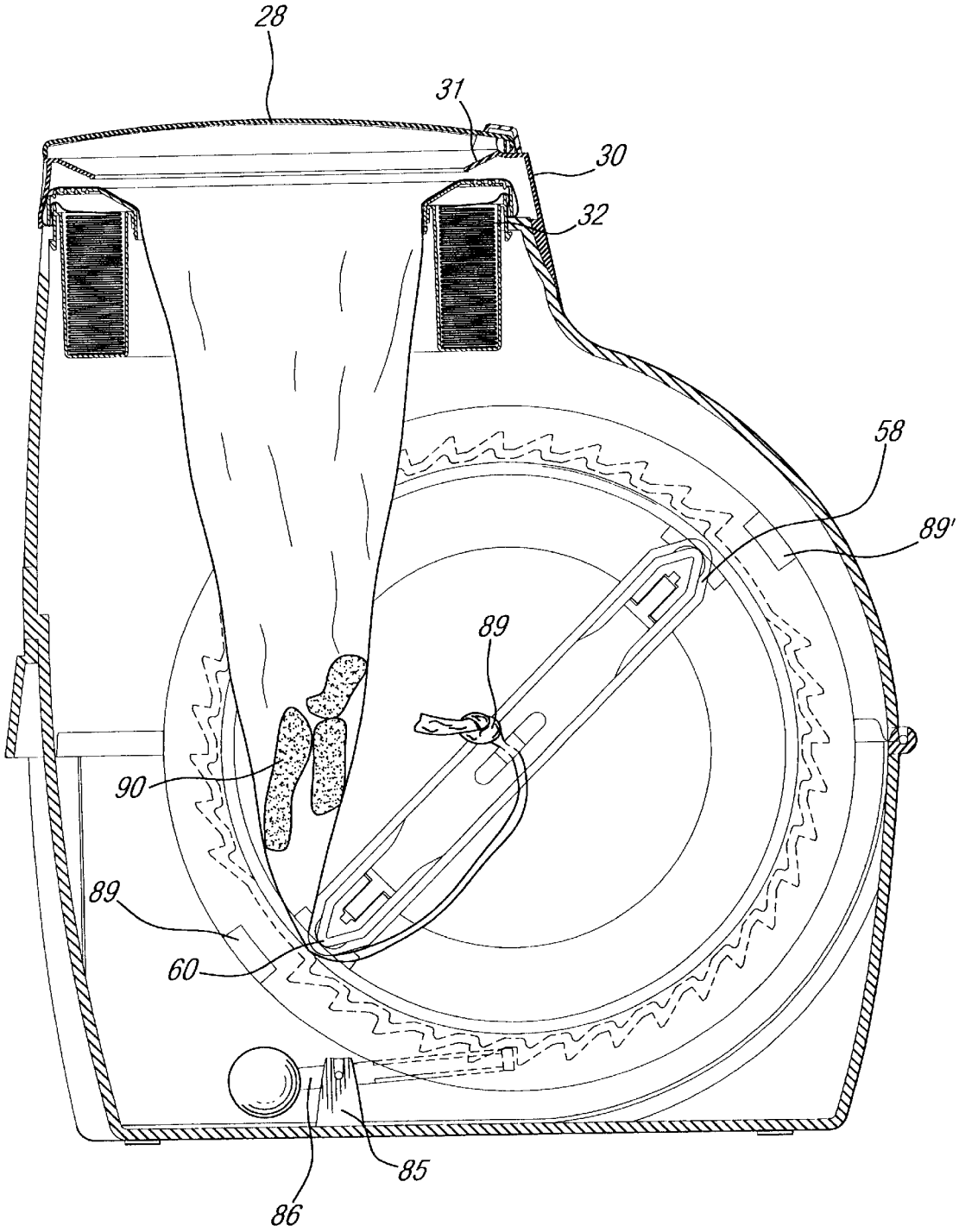
FIG. 5 is a cross-sectional view showing waste material received in the tubing.

Referring to FIG. 5, the cassette 26 contains a package 32 (see FIG. 5) of flexible pleated tubing 34; such cassette may be found described in applicant's co-pending Canadian patent applications serial number 2,366,384 filed Dec. 31, 2001 and serial number 2,387,183 filed May 22, 2002. A finger receiving flexible area 35 is provided to assist in removing the cover support 30 whenever it is necessary to replace an empty cassette with a new tubing filled cassette.

Figure 4:
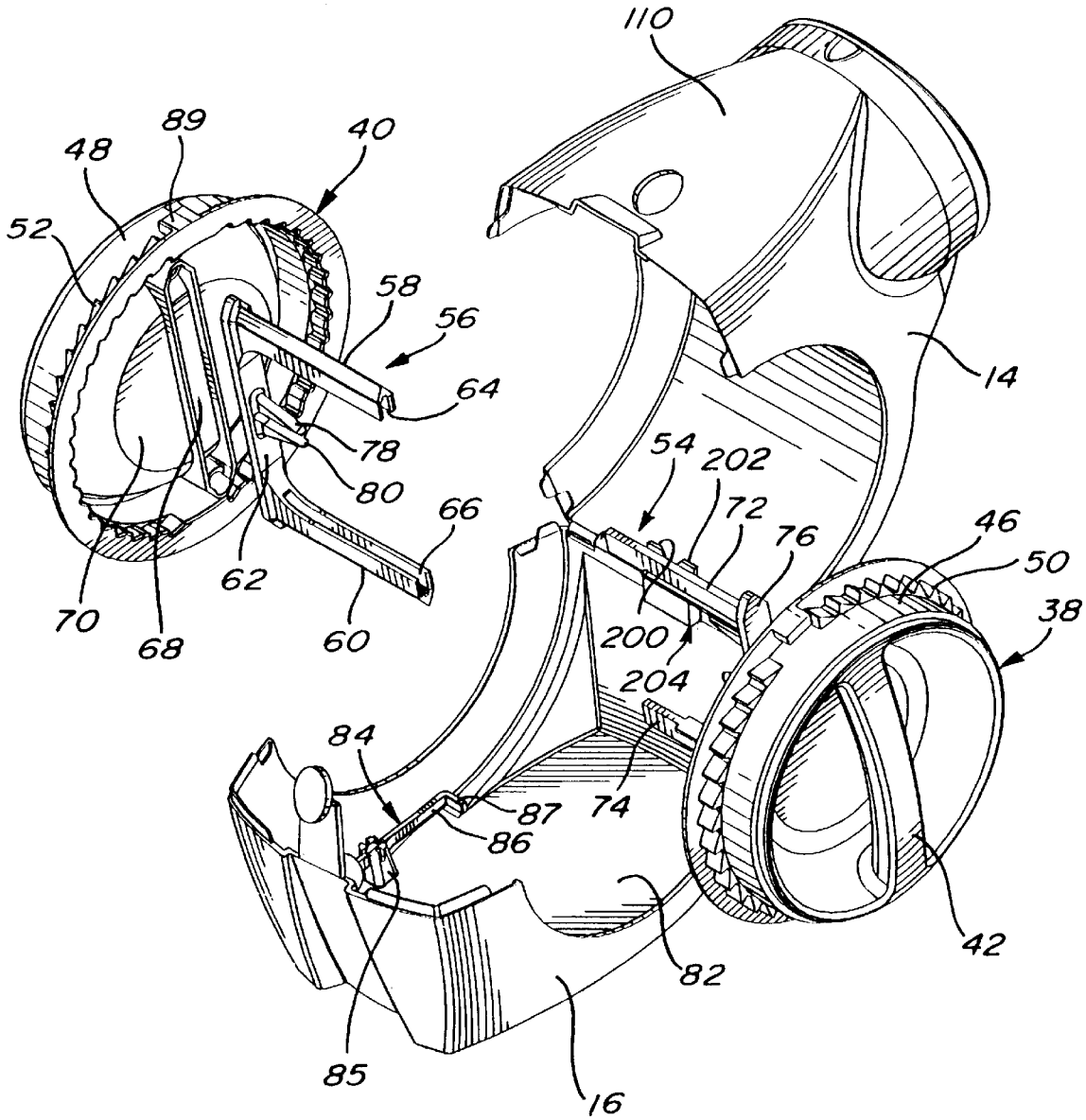
FIG. 4 is a perspective exploded view showing the drum unit separated from the housing of the apparatus.

The housing 10 includes a drum unit 36 which is illustrated in greater detail in FIGS. 3 and 4. The drum unit 36 first consists of a pair of wheels 38 and 40. In the embodiment illustrated, each wheel 38, 40 has a handle 42, 44 on its outer wall and a circumferential edge 46, 48 displaying a ratchet configuration 50, 52, the function of which will be further described hereinbelow. Alternatively, a ratchet arrangement may be provided on one wheel only.

The wheels are interconnected by means of a pair of a U-shaped arm arrangements 54 and 56. Referring more particularly to the U-shaped arm arrangement 56, it comprises two parallel arms 58 and 60 extending from a common connecting element 62 mounted to the wheel 40. Each arm 58 and 60 defines a channel 64, 66. In one form of the invention, the connecting element 62 is shaped so as to be fixedly mounted in a correspondingly shaped recess 68 integrally formed to the inner face 70 of the wheel. The U-shaped arm arrangement 54 is similarly assembled to the wheel 38; it comprises a pair of parallel arms 72 and 74 extending from a common connecting element 76.

The size and configuration of the arms 72 and 74 are such as to fit into their associated channels 64 and 66 of the arms 58 and 60.

The separation between the arms of each arm should be within a certain range; indeed, for a too short a distance, the drum would not operate properly while for a too great a distance, too much tubing material would be used.

The connecting element 62 displays a pair of integral spaced projecting fingers 78 and 80, the function of which will be described further hereinbelow.

Mounted to the bottom wall 82 of the bottom portion 16 of the apparatus, a pawl 84 is mounted on a support 85 and is L-shaped with an extremity 87 biased to come in contact with the ratchet 52 of the wheel. If needed, a similar pawl arrangement could also be provided on the other side of the bottom portion 16 to engage the ratchet 50 of the opposite wheel 38.

The ratchet and pawl arrangement will prevent the drum from rotating in a reverse manner; otherwise the arm folds, as described below, would lose their sealing effect on the packs. This is achieved by the extremity 87 of the pawl contacting a pair of stopping blocks 89, 89' diametrically disposed at the circumferential edge of wheel 40.

The operation of the container will now be described with reference to FIG. 5. A free end of tubing is first retracted from the package 34. A knot 89 is made at this free end of the tubing and inserted in the opening 24. Alternatively, with the top and bottom portions of the housing in the opened position shown in FIG. 3, the tubing may be pulled through the opening and then a knot performed to close the opened end.

Figure 6:
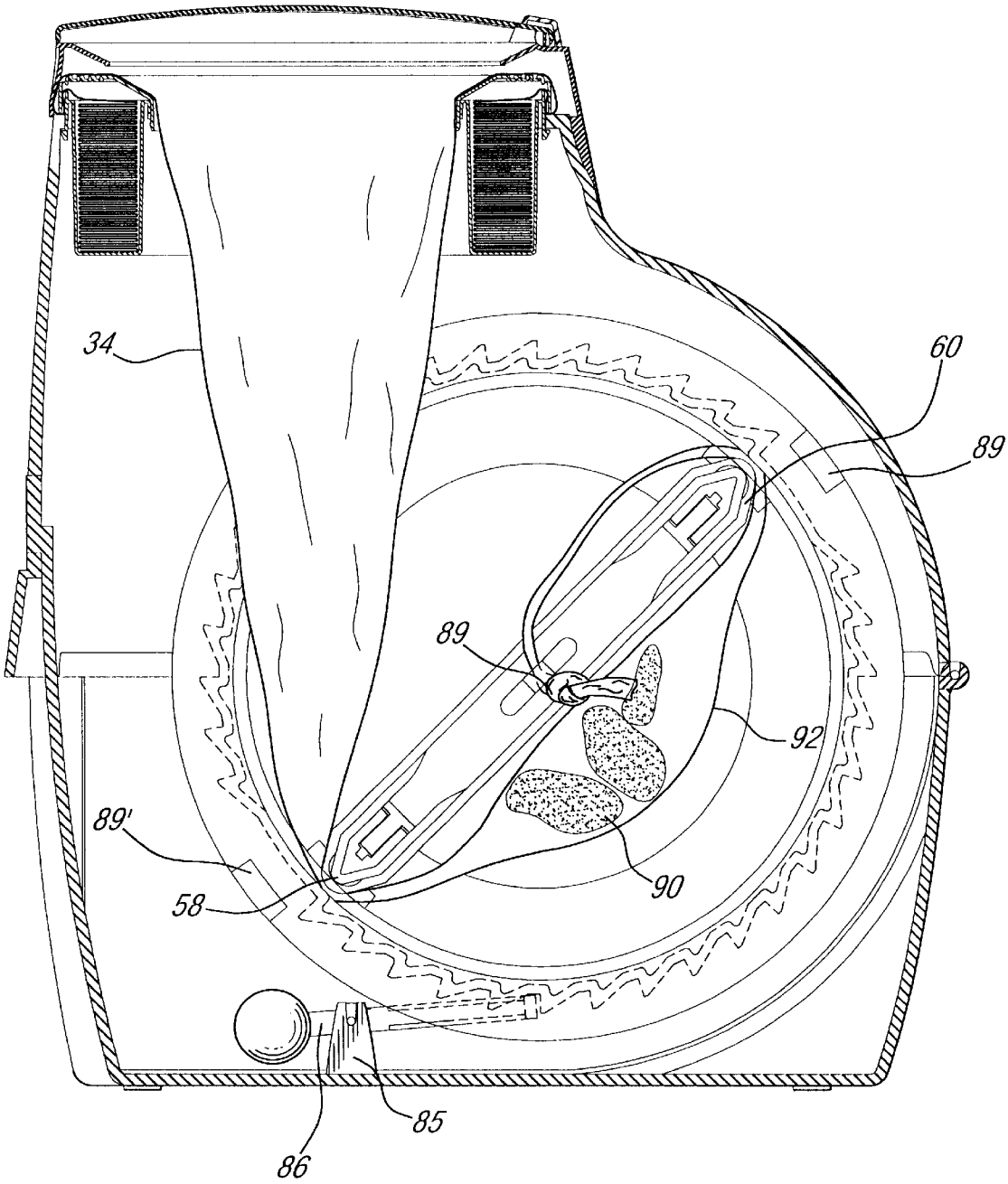
FIG. 6 is a cross-sectional view showing a first pack formed with the waste material of FIG. 5 after a 180° rotation of the drum unit.

The knot is slid between the pair of projections 78 and 80 of the wheel 40. In this position, the tubing may receive waste material 90. A rotation of 180° of the drum unit 36 until the extremity 87 contacts the stopping knock 89 will result in the arrangement illustrated in FIG. 6 wherein an individual waste-containing pack 92 is formed while the tubing 34 is ready to receive a successive filling of waste material.

The configuration of the outer walls of the arms 58 and 60 is preferably V-shaped so to form a tight fold of the tubing as it contacts these two locations thereby providing an air-tight seal for the pack 92 so that odours may be locked and prevented from returning up the tubing to the opening of the apparatus. Further rotation of the drum unit will provide a succession of packs 92 in a wraparound manner between the arms 58 and 60. The additional folds resulting from this wraparound configuration further increase the sealing effect since there is a superposition of packs at the folds.

Figure 7:
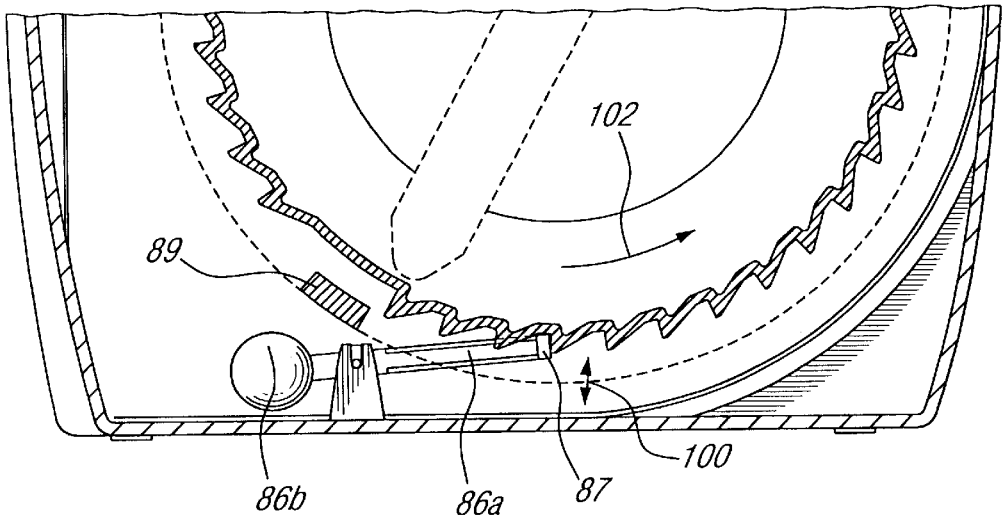
FIGS. 7 and 8 are enlarged cross-sectional views showing two positions of the ratchet and pawl arrangement of the apparatus.
Figure 8:
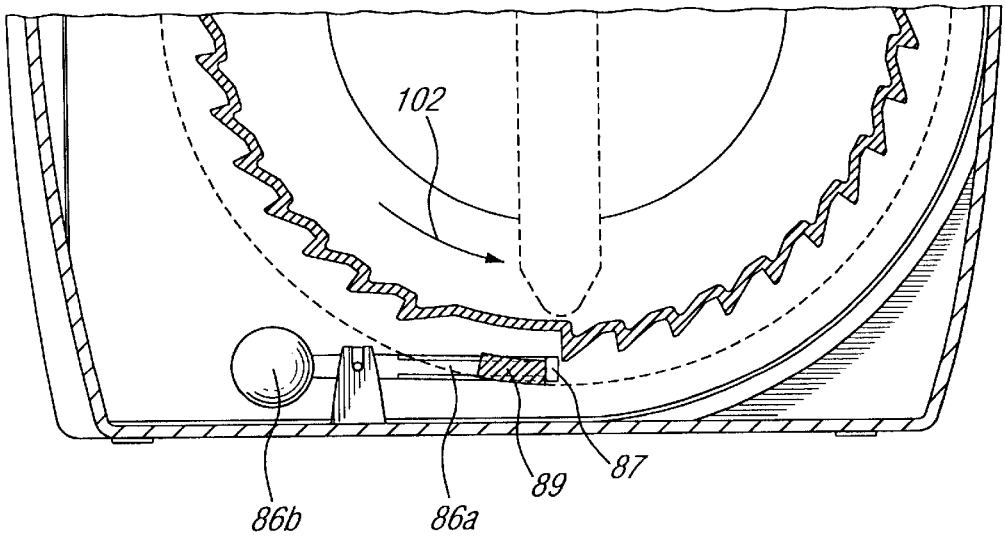

FIGS. 7 and 8 illustrate the operation of the pawl and ratchet arrangement to indicate to the user that the drum unit has rotated 180° and that the rotation of the drum unit should stop to receive additional waste material. One embodiment of the pawl ratchet arrangement is illustrated and consists of a weight 86*b* to provide a bias on the arm section 86*a* forcing the extremity 89 of the ratchet to move in the direction indicated by arrow 100. During the rotation of the drum in the direction indicated by arrow 102, the pawl extremity 89 is constantly biased to the ratchet teeth. However, block 89 acts as a stopper for the pawl extremity thereby indicating to the user that the drum has completed 180°. However, as soon as the pawl has contacted the block, it is again forced towards the ratchet arrangement to enable further rotation. Other indicating means may be possible instead of the stopping block to provide information to the user that a 180° rotation of the drum has been made.

When it is desired to disposed of the superposed waste containing packs supported on the arms of the drum unit, the tubing is severed by being inserted between knives 200 and 202 of a cutting element 204 mounted to the housing.

Subsequently, another knot is then formed to a new wraparound procedure of waste collecting.

Figure 9:
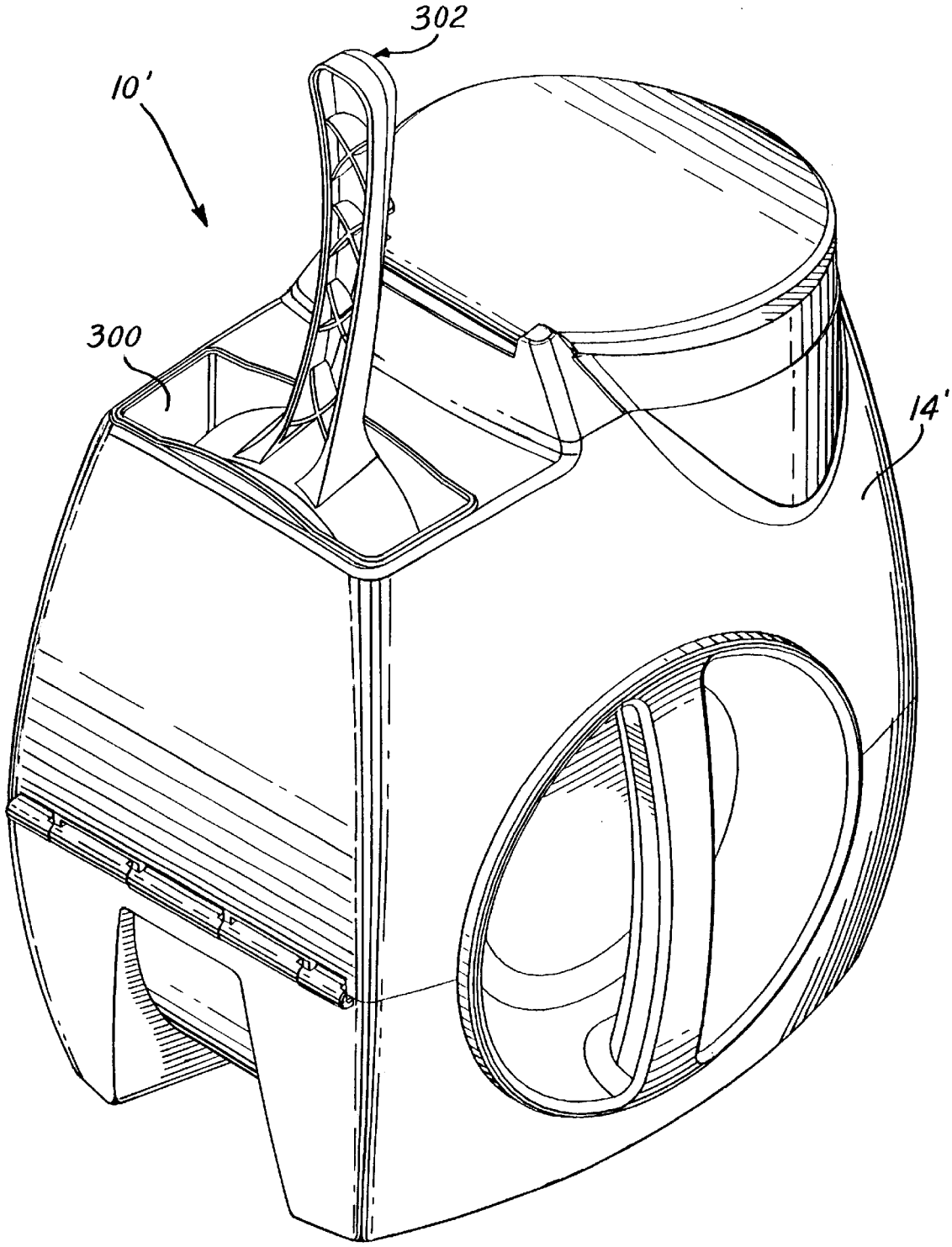
FIG. 9 is a perspective view of another embodiment of the apparatus of the present invention.
Figure 10:
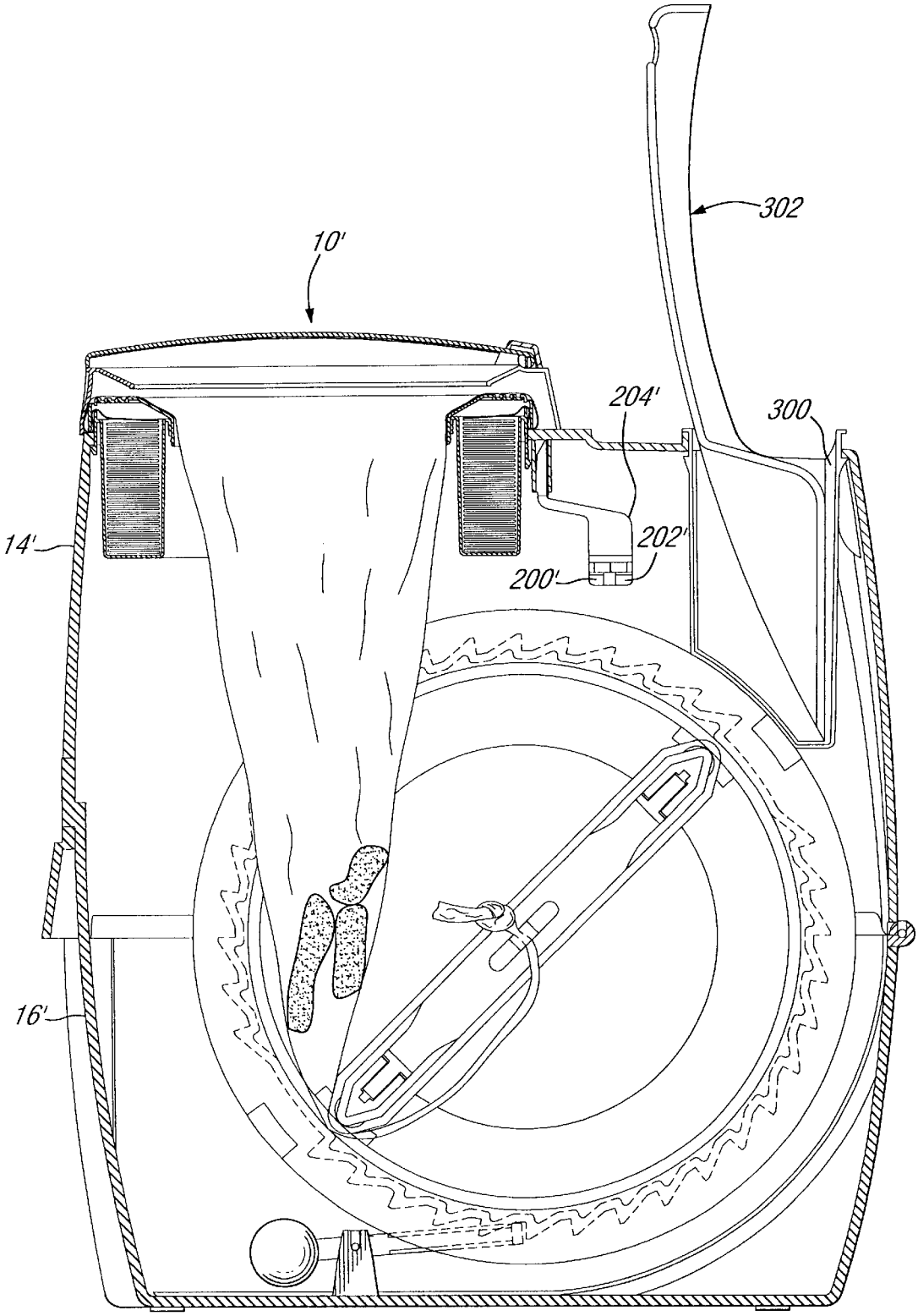
FIG. 10 is a cross-sectional view of the embodiment of FIG. 9.

FIGS. 9 and 10 show another embodiment 10' of the apparatus of the present invention wherein a pocket 300 is provided in the top portion 14' to receive a scoop 302. Also, in this embodiment, the cutting element 204' with its pair of cutting knives 200' and 2002' is shown mounted adjacent the upper opening of the top portion 14'. A description of the other components of this embodiment is not deemed necessary as they have been described above with reference to the embodiment illustrated in FIGS. 1–8.

One application of the apparatus of the invention is the collection of cat litter.

Although the invention has been described above with respect to one specific form, it may be modified and refined in various ways. For example, aeration holes 110 may be provided on the housing to prevent the accumulation of odours inside the apparatus. The arms could be replaced by a solid member having opposite fold forming extremities. It is therefore wished to have it understood that the present invention should not be limited in interpretation except by the terms of the following claims.

What is claimed is:

1. Apparatus for forming and containing a series of waste containing packs successively distributed along a length of flexible tubing comprising:

a housing having a top portion and a bottom portion; said top portion displaying an opening to receive waste material therein;

a cassette mounted to said top portion at said opening; said cassette containing a package of flexible pleated tubing and being so constructed as to enable said tubing to be dispensed therefrom and downwardly into said opening; and a tubing pulling device rotatably mounted to said housing; said device including:

(i) attachment means for securing one end of said tubing in said housing;

(ii) means receiving said tubing in a wraparound manner when said pulling device is rotated to form waste containing packs; said receiving means defining tubing folds between successive packs thereby compressing said tubing at said folds to seal said packs;

wherein said pulling device is removably mounted from said housing to enable disposal of said waste containing packs from said pulling device.

2. An apparatus as defined in claim 1, wherein said tubing receiving means consist of a pair of arms disposed diametrically opposite from one another; sections of said tubing extending between said arms defining said waste containing packs.

3. An apparatus as defined in claim 2, wherein said pulling device includes a pair of opposite wheels mounted to opposite ends of said arms thereby forming a rotatable drum unit.

4. An apparatus as defined in claim 2, wherein each said arm is formed of a pair of inter-engaging members; said members being separatable from one another to facilitate removal and disposal of said packs wrapped thereon.

5. An apparatus as defined in claim 3, wherein at least one of said wheels displays a circumferential ratchet; said bottom portion of said housing including a pawl to engage said ratchet of said wheel.

6. An apparatus as defined in claim 3, wherein at least one of said wheels displays on an outer wall thereof a handle to facilitate rotation of said wheel.

7. An apparatus as defined in claim 5, wherein said circumferential ratchet displays stopper means to engage said pawl.

8. An apparatus as defined in claim 6, wherein said stopper means consist of a pair of stopping elements diametrically disposed on said circumference edge.

9. An apparatus as defined in claim 5, wherein said pawl is biased against said ratchet.

10. An apparatus as defined in claim 3, wherein said upper and lower portions of said housing are hingedly connected to one another allowing said housing to open to enable removal of said drum unit therefrom.

11. An apparatus as defined in claim 1, further comprising cutter means in said housing to sever said tubing for separating said packs on said arms from said tubing extending into said housing.

12. An apparatus as defined in claim 1, further comprising lid means mounted at said upper portion of said housing for closing said opening.

13. An apparatus as defining in claim 1, wherein said housing includes aeration holes.

14. An apparatus as defined in claim 12, wherein said lid means consist of a cover and a cover support fixed to the top portion of said housing; said cover being pivotally mounted to said cover support.

15. An apparatus as defined in claim 14, wherein said cover support displays a sloped inner wall over said opening of said housing.

16. An apparatus as defined in claim 1, wherein said top portion of said housing displays a scoop receiving area.

* * * * *